US008495934B2

(12) United States Patent
Schneider et al.

(10) Patent No.: US 8,495,934 B2
(45) Date of Patent: Jul. 30, 2013

(54) FLEXIBLE SOCKET WRENCH EXTENSION

(76) Inventors: Steven Schneider, San Rafael, CA (US); Dave Garoutte, San Rafael, CA (US)

( * ) Notice: Subject to any disclaimer, the term of this patent is extended or adjusted under 35 U.S.C. 154(b) by 359 days.

(21) Appl. No.: 12/797,775

(22) Filed: Jun. 10, 2010

(65) Prior Publication Data

US 2011/0303053 A1 Dec. 15, 2011

(51) Int. Cl.
*B25G 1/02* (2006.01)

(52) U.S. Cl.
USPC ..... 81/177.6; 81/177.75

(58) Field of Classification Search
USPC ..... 81/177.6, 177.2, 177.7, 177.75, 177.85, 81/57.43; 464/159; 403/122–144
See application file for complete search history.

(56) References Cited

U.S. PATENT DOCUMENTS

| | | | | | |
|---|---|---|---|---|---|
| 1,111,645 | A * | 9/1914 | Chadwick | 464/158 |
| 2,425,809 | A * | 8/1947 | Johnson | 464/157 |
| 3,378,286 | A * | 4/1968 | Gottschald | 403/51 |
| 3,897,703 | A * | 8/1975 | Phipps | 81/177.75 |
| 4,156,354 | A * | 5/1979 | Krude | 464/141 |
| 5,455,997 | A * | 10/1995 | Nasiell | 29/456 |
| 5,851,208 | A * | 12/1998 | Trott | 606/80 |
| 6,862,958 | B2 * | 3/2005 | Schade | 81/177.6 |
| 2010/0294089 | A1 * | 11/2010 | Lai | 81/177.6 |
| 2011/0197719 | A1 * | 8/2011 | Neitzell et al. | 81/177.75 |

* cited by examiner

*Primary Examiner* — Alicia Torres
(74) *Attorney, Agent, or Firm* — Richard B. Main; Main Law Firm

(57) ABSTRACT

A tool extension for a socket wrench includes a jointed, articulated series of square-drive male/female adapter ends with intermediate couplers having hex ball-head and socket joints. Three such intermediate couplers together in one series allow for an overall 90-degrees of flex. Each coupler has a bell body over which a pliable control cover is stretched. Each hex ball head and socket joint is bridged over by a corresponding pliable control cover which then snaps over a retaining lip just under a neck.

7 Claims, 5 Drawing Sheets

Fig. 3A
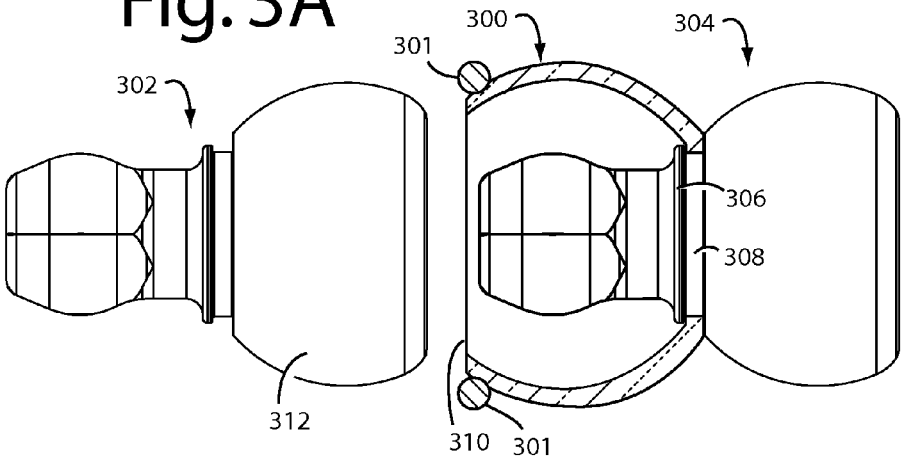
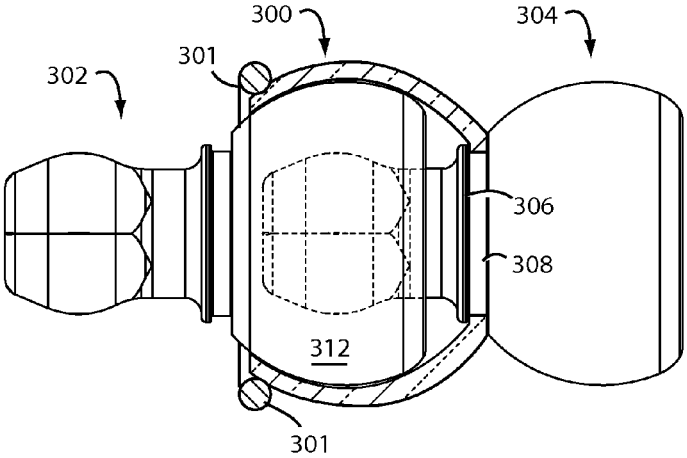
Fig. 3B
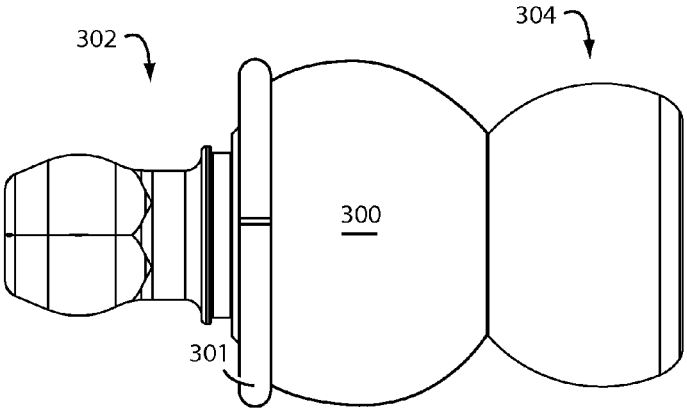
Fig. 3C

FLEXIBLE SOCKET WRENCH EXTENSION

FIELD OF THE INVENTION

The present invention relates to hand tools, and more particularly to socket wrench extensions that can flex around or avoid interfering objects.

DESCRIPTION OF THE PRIOR ART

Nuts and bolts on cars and other machinery are not always easily accessible with a socket wrench or conventional extension. Other parts of the machinery can interfere with a straight shot. However, the socket itself needs to be slipped on straight over the hex bolt head or nut, otherwise the socket will pop off when any torque is applied.

Conventional solutions to this problem include rigid, square drive socket extensions with universal (wobble) joints on one or both ends that come in a variety of lengths. These seem to work OK if all that is needed is a simple angle off the head of the bolt head or nut. If the access interference is more complex than that, a fixed length wobble-joint extension is not going to work.

Some mechanics that have several short length wobble-joint extensions plug a series of them together to help snake a socket down onto a hex head bolt or nut. But this ad hoc solution kinks too easily and flops around too readily. Very often no real torque can be applied, the square drive joints in the extensions just do not provide the right kind of coupling needed.

There is a need for a socket wrench extension that can be snapped on to conventional square-drive ratchet handles and sockets, and that allows the tool to snake in past various obstacles to a hex bolt head or nut.

SUMMARY OF THE INVENTION

Briefly, a tool extension embodiment of the present invention comprises for a socket wrench includes a jointed, articulated series of square-drive male/female adapter ends with intermediate couplers having hex ball-head and socket joints. Three such intermediate couplers together in one series allow for an overall 90-degrees of flex. Each coupler has a bell body over which a pliable control cover is stretched. Each hex ball head and socket joint is bridged over by a corresponding pliable control cover which then snaps over a retaining lip just under a neck.

These and other objects and advantages of the present invention will no doubt become obvious to those of ordinary skill in the art after having read the following detailed description of the preferred embodiments which are illustrated in the various drawing figures.

IN THE DRAWINGS

FIG. 3A is an assembly view diagram with a cross section of a pliable control cover showing how the small end of a pliable control cover is snapped on a lip of a male end of an intermediate coupler before the two are engaged with the female end and bell body of a next intermediate coupler;

FIG. 3B is a side view diagram showing the two intermediate couplers engaged and the pliable control cover (still in cross section) fitted in place; and FIG. 3C is a side view diagram like FIG. 3B showing the two intermediate couplers engaged and the pliable control cover ready for use.

DETAILED DESCRIPTION OF THE PREFERRED EMBODIMENT

Figure 1A:
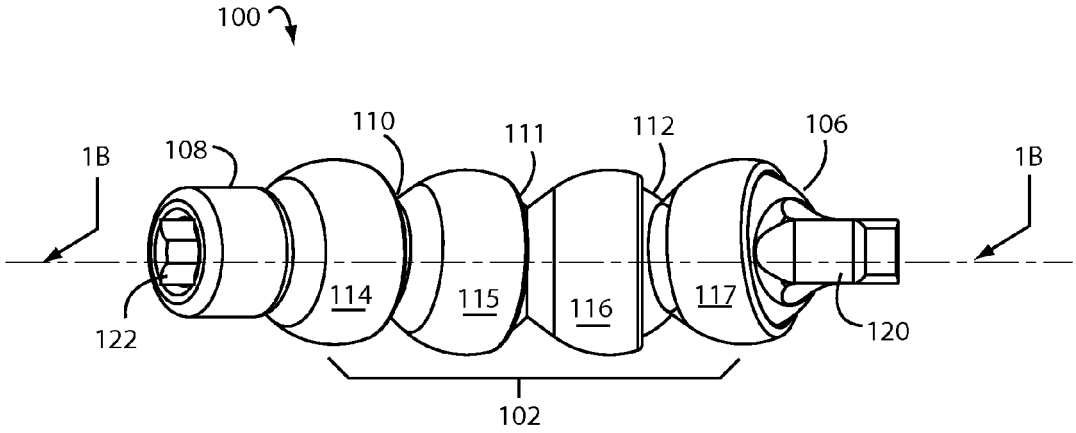
FIG. 1A is a side perspective view diagram of a tool extension embodiment of the present invention with three intermediate couplers and four pliable control covers, and shown arched away.
Figure 1B:
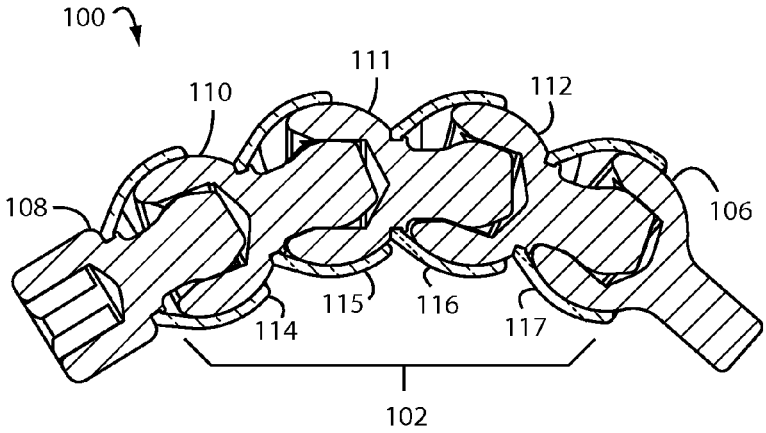
FIG. 1B is a cross sectional diagram of the tool extension of FIG. 1A taken along the line 1B-1B, and shown arched upwards.
Figure 1C:
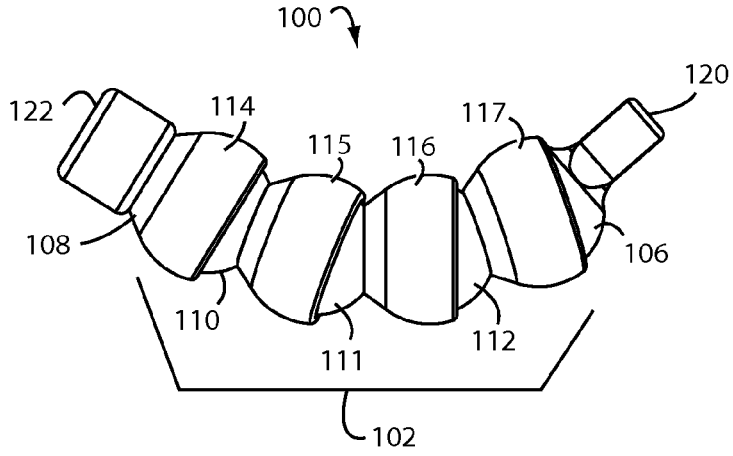
FIG. 1C is a side perspective view diagram of the tool extension of FIG. 1A shown arched downwards.
Figure 1D:
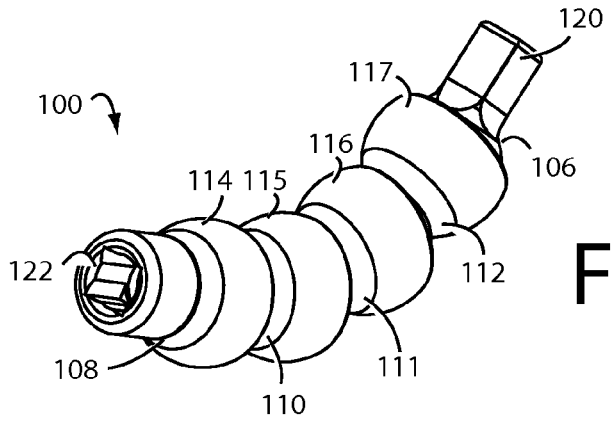
FIG. 1D is a side-end perspective view diagram of the tool extension of FIG. 1A shown arched down and to the left with the female adapter end closest.
Figure 1E:
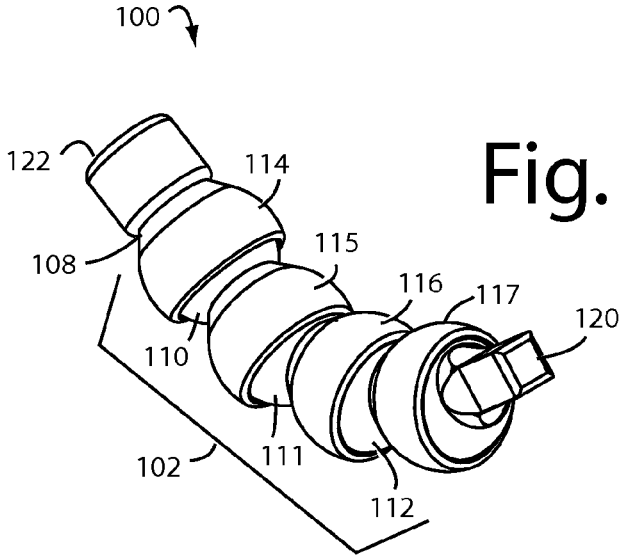
FIG. 1E is a side-end perspective view diagram of the tool extension of FIG. 1A shown arched down and to the right with the male adapter end closest.

FIGS. 1A-1E illustrate a tool extension embodiment of the present invention, and is referred to herein by the general reference numeral 100. Tool extension 100 enables the installation and removal of screws, bolts, and nuts where easy, straight on access is not possible. A flexible coupling 102 is able to transmit substantial torque around corners, greatly simplifying certain assembly and disassembly operations. The flexible coupling 102 is able to extend an attached socket wrench to a hex head bolt or nut from straight-on to a curve around 90-degrees. This allows such tool to access intricate areas.

Tool extension 100 includes a male square-to-hex drive adapter 106, a female square-to-hex drive adapter 108, a number of couplings 110-112, and corresponding pliable control covers 114-117. A typical commercial product would include a male and female square drive, three hex couplings, and four pliable control covers. Such will permit an extension around a 90-degree corner. Commercial products will have finishes for these pieces in attractive colors and textures, and use durable materials like stainless steel, nitrile, and poly carbonate. A male square-drive end 120 would typically be provided in ¼", ⅜", or ½" American sizes. A female square-drive end 122 would be provided in matching ¼", ⅜", or ½" American sizes. Of course, metric sizes would also be useful, especially in other parts of the world In between the square drives, the joints between couplings 110-112 use hex slip joints for smooth articulation.

Figure 2A:
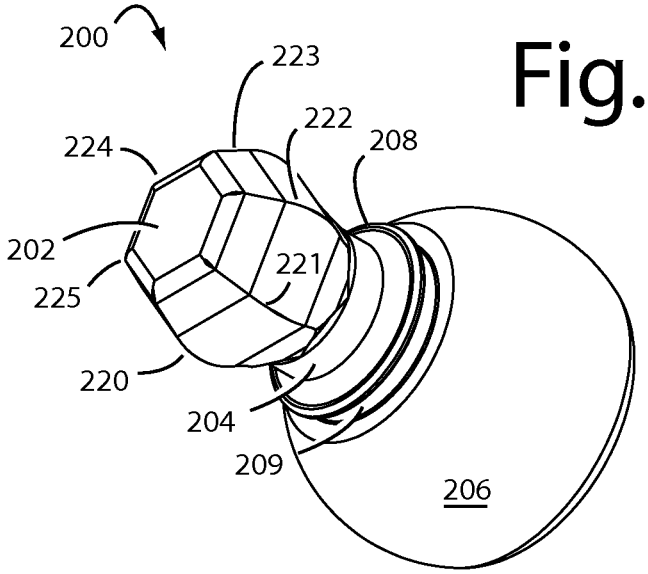
FIG. 2A is a side-end perspective view diagram of an intermediate coupler embodiment of the present invention as used in FIGS. 1A-1E with the male end forward, up and to the left.
Figure 2B:
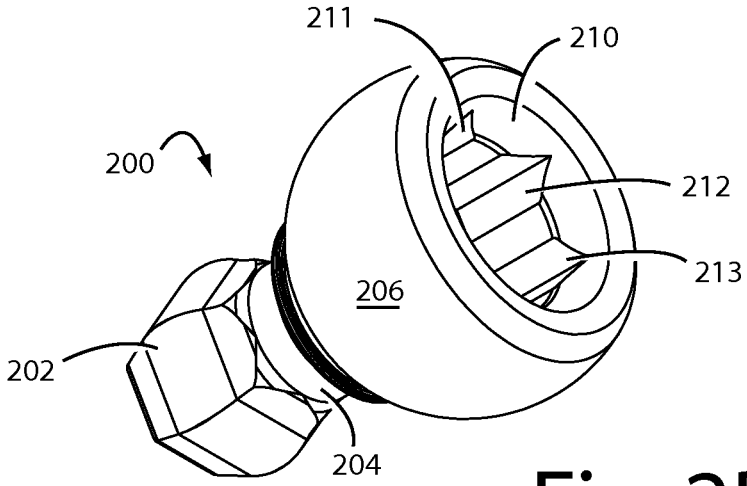
FIG. 2B is a side-end perspective view diagram of the intermediate coupler of FIG. 2A with the female end forward, up and to the right.
Figure 2C:
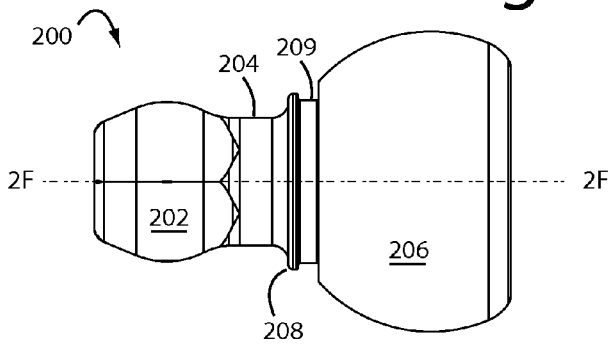
FIG. 2C is a side view diagram of the intermediate coupler of FIG. 2A with the male end to the left.
Figure 2D:
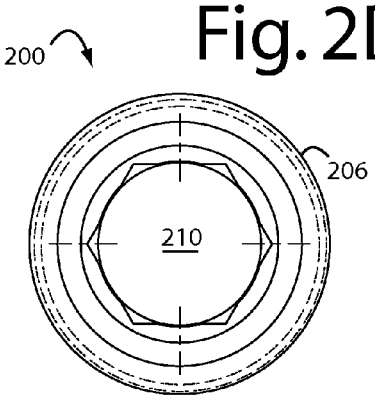
FIG. 2D is an end view diagram of the intermediate coupler of FIG. 2A with the female end to the front.
Figure 2E:
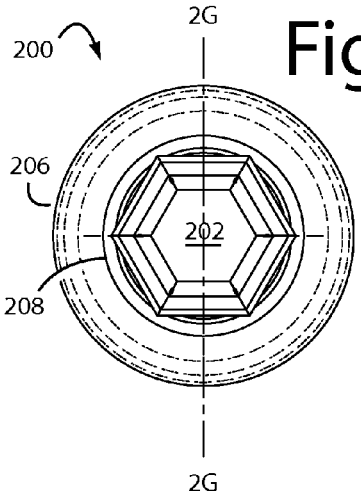
FIG. 2E is an end view diagram of the intermediate coupler of FIG. 2A with the male end to the front.
Figure 2F:
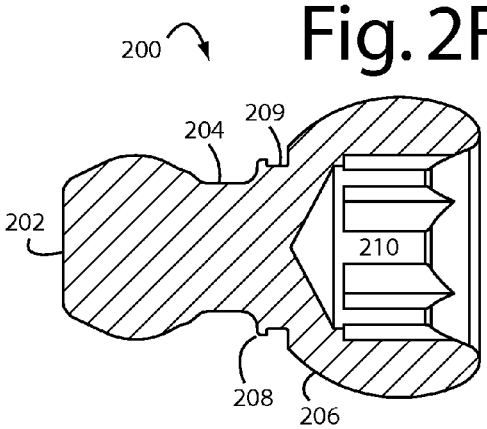
FIG. 2F is a cross sectional diagram of the intermediate coupler of FIG. 2A taken along the line 2F-2F in FIG. 2C on the edges of the facets on the male and female ends.
Figure 2G:
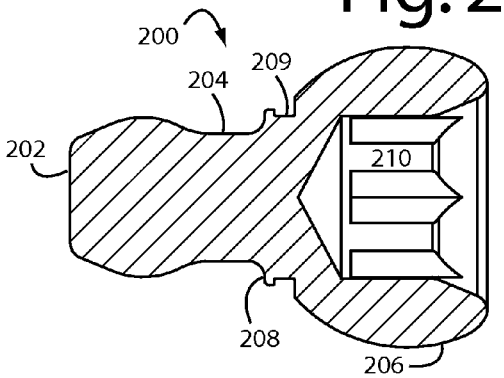
FIG. 2G is a cross sectional diagram of the intermediate coupler of FIG. 2A taken along the line 2G-2G in FIG. 2E on the flat faces of the facets on the male and female ends.

FIGS. 2A-2G represent an intermediate hex-drive coupling 200 in an embodiment of the present invention. Such intermediate hex-drive coupling 200 could be used for any of couplings 110-112 in FIG. 1. Each intermediate hex-drive coupling 200 includes a hex-faceted ball head 202 connected through a neck 204 to a bell body 206. Just below the neck 204 is a cover lip 208 and groove 209. A pliable control cover, like pliable control covers 114-117 in FIGS. 1A-1E, locks on by snapping over around cover lip 208 tightly locking on to groove 209. The pliable control cover then extends over hex-faceted ball head 202 to cup over and socket a bell body of a next coupling in a daisy chain assembly of couplings 200. The fit of such pliable control cover slips around on the bell body, and is carefully configured so that the joint can flex smoothly when pressure is applied, but not so loose as to be able to flop around on its own.

Pliable control covers, in general, should be made of plastic or rubber materials that can stretch or yield enough to be pulled or snapped over cover lips 208 and bell bodies 206. A retaining ring may be employed to secure the joint. Useful materials include plastics and rubbers like nylon, polyurethane, Nitrile rubber (Buna-N), latex, and EDM rubber. The main surface areas of bell bodies 206 should be smooth and spherical, and stainless steel or chrome plating would help to maintain a consistently smooth and clean surface texture over many years of use.

A hex receptacle 210 accepts the hex-faceted ball head 202 and has six grooves in a partial or full hex typified by grooves 211-216. These engage six corresponding arched facet edges on the next adjoining coupling, typified by arched facet edges 220-226. The resulting joint between a hex-faceted ball head 202 and the next hex receptacle 210 is able to flex and pivot. It also resembles the joints in a Loc-Line® segmented coolant hose. See, http://www.loc-line.com/. However, the hex grooves and matching arched facet edges will transmit twisting torque rather than allow any coaxial slip.

In general, tool extension embodiments of the present invention are able to transmit torque effectively and their many joints will stay positioned on their own. The hex-faceted joints are machined and sized to hold themselves together, and yet offer only a modest amount of resistance to pivoting when applying torque on the socket wrench. The machine tolerances of the hex interface are therefore important to balance with one another. Spring loaded ball detents could be included to help one coupling retain the next one in a series, but the pliable control covers themselves should be adequate if their fit is maintained right.

The plastic or rubber pliable control covers can further act to seal out contaminants and hold in lubricants. It may be necessary to add grooves or slots to allow the spherical end to flex sufficiently for assembly. The wall thickness and material stiffness of the pliable control covers are used to optimize the inter-joint tension. Each coupling 200 is configured with joints that are able to pivot up to 22.5-degrees off normal straight line with the next coupling. A tool extension 100 (FIGS. 1A-1E), for example, with four joints could then flex 90-degrees overall.

A variety of modes were tried in experiments to find an effective way the tool extension to hold itself in a given angle of flex. Magnets, sleeving, and tubing were tried or considered. The solution described in FIGS. 1A-1E and 2A-2E greatly simplified the machining and assembly of the tool extension 100 by eliminating an interior groove and snap-ring, which were otherwise needed to hold the individual links together.

The critical challenges to manufacture of this tool are the fit and finish of the hex (male and female) and the accuracy of the spherical interface, allowing the requisite amount of resistance to movement. Choosing the best variety of plastic and determining the final dimensions of the pliable control cover will be somewhat challenging. Flexibility for assembly, chemical resistance and stability and general toughness being the main things that come to mind.

FIGS. 3A-3C represent a pliable control cover 300 in an embodiment of the present invention. A retaining ring 301 is disposed along an open lip of pliable control cover 300 for preventing disassembly from a next component like an intermediate coupler or adapter end. Pliable control covers 300 are used to join together two intermediate couplers 302 and 304. FIG. 3A shows that pliable control cover 300 is installed on coupler 304 by snapping it over a lip 306 onto a groove 308. FIG. 3B shows that pliable control cover 300 has an opening 310 that was stretched over a bell body of coupler 302 to assemble the two couplers together. FIG. 3C shows the final assembled appearance.

The retaining ring 301 can be constructed like a conventional snap ring, hose clamp, or similar.

An improved method embodiment of the present invention for extending a socket wrench with jointed intermediate couplers and square drive adapter ends is characterized by disposing a bell body having a generally spherical surface with a lip and groove mounted on one end of each of the jointed intermediate couplers and a square drive adapter end. A pliable control cover is stretched over the bell body from an opposite end of each corresponding intermediate coupler to flexibly socket the adjoining parts together. The pliable control cover is retained over the bell body with a ring or clamp on an open lip.

Although the present invention has been described in terms of the presently preferred SPS receivers, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

What is claimed is:

1. A tool extension, comprising:

a plurality of intermediate couplers, and each having a hex-faceted male end and a matching female end that, when engaged with each other, form a hex slip joint for permitting substantial pivoting between the male and female ends;

a bell body disposed on each female end of a corresponding intermediate coupler and having a generally smooth and spherical main surface;

a lip and an adjacent groove disposed on each of a corresponding intermediate coupler between a neck of the male end and the bell body;

a plurality of pliable control covers each configured on a first end to be snapped over the lip and into the adjacent groove of a corresponding intermediate coupler, and configured on a second end to cup, bridge over, and socket with a bell body of a next coupler to keep the two adjacent couplers connected during use;

wherein each pliable control cover sockets over a next bell body such that said hex slip joint can flex smoothly when pressure is applied without flopping around or disconnecting.

2. The tool extension of claim 1, further comprising:

a male square-drive adapter end for terminating a series of the plurality of intermediate couplers by providing a hex-faceted male end or a matching female end for connection to a corresponding intermediate coupler.

3. The tool extension of claim 1, further comprising:

a female square-drive adapter end for terminating a series of the plurality of intermediate couplers by providing a hex-faceted male end or a matching female end for connection to a corresponding intermediate coupler.

4. The tool extension of claim 1, further comprising:

a square-drive adapter end for terminating a series of the plurality of intermediate couplers by providing a hex-faceted male end or a matching female end for connection to a corresponding intermediate coupler; and an adapter bell body disposed on one end of the square-drive adapter end having a generally spherical surface;

wherein, a pliable control cover mounted over a lip and groove of said corresponding intermediate coupler can be stretched and socketed over the adapter bell body.

5. The tool extension of claim 1, further comprising:

a retaining ring disposed along an open lip of the pliable control cover and configured to prevent disassembly from a next coupler.

6. An improved method for extending a socket wrench with jointed intermediate couplers and square drive adapter ends; characterized by:

disposing a bell body having a generally spherical surface with a lip and groove mounted on one end of each of said jointed intermediate couplers and a square drive adapter end; and stretching a pliable control cover, retained in the lip and groove, over said bell body from an opposite end of a corresponding intermediate coupler to flexibly socket the adjoining parts together;

wherein the fit of the pliable control cover over the bell body is configured such that a joint disposed within can flex smoothly when pressure is applied without flopping around or disconnecting.

7. The method of claim 6, further comprising:

retaining said pliable control cover over said bell body with a ring or clamp on said pliable control cover.

* * * * *